US008133009B2

(12) United States Patent
Salvesen

(10) Patent No.: US 8,133,009 B2
(45) Date of Patent: Mar. 13, 2012

(54) CENTRIFUGAL FAN

(75) Inventor: Tormod Salvesen, Sør-Audnedal (NO)

(73) Assignee: Umoe Mandal AS, Mandal (NO)

( * ) Notice: Subject to any disclaimer, the term of this patent is extended or adjusted under 35 U.S.C. 154(b) by 894 days.

(21) Appl. No.: 12/064,817

(22) PCT Filed: Sep. 27, 2006

(86) PCT No.: PCT/NO2006/000333

§ 371 (c)(1),
(2), (4) Date: Mar. 6, 2008

(87) PCT Pub. No.: WO2007/037699

PCT Pub. Date: Apr. 5, 2007

(65) Prior Publication Data

US 2008/0232967 A1 Sep. 25, 2008

Related U.S. Application Data

(60) Provisional application No. 60/720,498, filed on Sep. 27, 2005.

(51) Int. Cl.
*F04D 29/28* (2006.01)
*F04D 29/42* (2006.01)

(52) U.S. Cl. ..... 415/118; 415/201; 416/186 R; 416/198 R; 416/214 R; 416/219 R

(58) Field of Classification Search ..... 416/186 R, 416/198 R, 200 R, 214 R, 219 R, 220 A; 415/118, 201
See application file for complete search history.

(56) References Cited

U.S. PATENT DOCUMENTS

| | | | | | |
|---|---|---|---|---|---|
| 2,262,039 | A | * | 11/1941 | Pekor | 416/186 R |
| 3,171,586 | A | | 3/1965 | Ariewitz | |
| 3,662,198 | A | * | 5/1972 | Adams, Jr. | 310/89 |
| 3,856,434 | A | | 12/1974 | Hoffmann | |
| 4,879,483 | A | * | 11/1989 | Barahia | 310/63 |
| 5,046,922 | A | * | 9/1991 | Nakamura et al. | 415/172.1 |
| 5,165,855 | A | * | 11/1992 | Ricketts et al. | 416/178 |
| 5,361,926 | A | * | 11/1994 | Messner | 494/38 |
| 5,517,925 | A | * | 5/1996 | Early | 105/377.07 |
| 5,546,648 | A | * | 8/1996 | Tarrant | 29/598 |
| 5,693,992 | A | * | 12/1997 | Kurusu et al. | 310/63 |
| 6,000,906 | A | * | 12/1999 | Draskovich | 415/209.4 |
| 6,138,740 | A | * | 10/2000 | Chou | 160/319 |
| 6,402,467 | B1 | | 6/2002 | Godichon et al. | |
| 2004/0241000 | A1 | | 12/2004 | Godichon et al. | |
| 2007/0098556 | A1 | * | 5/2007 | Sanagi et al. | 416/182 |

FOREIGN PATENT DOCUMENTS

| | | | |
|---|---|---|---|
| DE | 536438 | | 10/1931 |
| JP | 50-045445 | * | 4/1975 |
| JP | 11-303799 | * | 11/1999 |
| JP | 2005-155510 | * | 6/2005 |

* cited by examiner

*Primary Examiner* — Edward Look
*Assistant Examiner* — Liam McDowell
(74) *Attorney, Agent, or Firm* — Christian Abel

(57) ABSTRACT

An impeller device (10) for centrifugal fans (1), having comprising a center wheel (40), at least one side disc (20, 30) and fan blades (50). The center wheel (40) and the side disc(s) (20, 30) are equipped with attachment devices (24, 44) for attaching the blades and the center wheel's (40) attachment device (44) comprises a protrusion (45) extending substantially in the center wheel's radial direction and arranged to abut against the second side end (54) in the fan blades (50).

11 Claims, 15 Drawing Sheets

40
42
45
102
103
104
105
144
A
A

CENTRIFUGAL FAN

FIELD OF THE INVENTION

The present invention relates to an impeller device for centrifugal fans and to a centrifugal fan comprising an impeller device. The invention particularly relates to centrifugal fans, which are employed as a lift fan for hovercraft and are entirely or partly made of composite materials such as glass- or carbon fibre-reinforced epoxy, poly- or vinyl ester, or thermoplastics.

BACKGROUND

There are several types of fans, designed in different ways based on different areas of application, fluid, flow rate and pressure increase capacity. Centrifugal fans are one of several types of fans, which amongst other things are especially suitable for use as lift fans for hovercraft.

Larger centrifugal fans are generally constructed of metallic materials, such as steel, acid-proof steel or aluminium. These fans typically have a very high rotation speed that generates enormous centrifugal forces, corresponding to 1000-4000 times the gravitational acceleration on the fan blades. The fan construction must therefore be extremely robust to enable those great forces to be absorbed in the structure.

U.S. Pat. No. 3,171,586 describes a metallic centrifugal fan with a rotor and airfoil blades bolted thereto. The blades are fixed to a side plate and to a back plate by means of studs and nuts. These bolts extend on part of the blade and are intended to provide hard joints, where short studs are subjected to shear and tension with no bending. Said studs do not provide any strengthening of the blades.

For use in military vessels there are also requirements regarding magnetic signature from the vessel and its systems. Rotating metal structures, for example, produce a disturbance in the earth's magnetic field that can be intercepted by special sensors. It is therefore vital that fans produce minimal electrical eddy currents. This is solved by using materials with low electrical conductivity in the construction of the fan, where in addition each individual part is electrically insulated from the others.

Existing designs of centrifugal fans in composite have employed an unsatisfactory method for attaching the blades to side disc and centre wheel, whereby substantial shear forces are generated in the bolt connection. This has resulted in a short service life and also several cases of fan breakdown.

U.S. Pat. No. 6,402,467 describes an impeller including vanes, first and second coaxial discs formed from composite material on opposite sides of the vanes to fix the vanes in position and a reinforcing collar. The inner surfaces of the discs comprise depressions intended to receive wings of vanes, these are vacuum bonded to the discs. If one vane is defect and must be replaced, the discs must be removed.

The object of the present invention is thus to provide a robust centrifugal fan which is entirely or partly made of composite materials and which avoids the above-mentioned disadvantages related to the attachment/removal of the blades and at the same time provides correct load transfer from the blades. It is a further object to obtain a centrifugal fan with a low magnetic signature.

Furthermore, the centrifugal fan according to the invention has a low moment of inertia, thus enabling start-up of the fan to be implemented without a complicated coupling and/or gear device between fan and drive motor.

SUMMARY OF THE INVENTION

Thus the invention relates to an impeller device for centrifugal fans, comprising a centre wheel, at least one side disc and fan blades where the fan blades have a first side end and a second side end, and where the centre wheel and the side disc(s) are equipped with attachment devices for attaching the blades. The invention is characterised in that the centre wheel's attachment device comprises a protrusion extending substantially in the centre wheel's radial direction and arranged to abut against the second side end of the fan blades.

Each protrusion can comprise a curved end located closest to the centre of the centre wheel, and being adapted to receive a part of the fan blade's second side end.

The side wheel's attachment devices can also comprise recesses for receiving the first side end of the fan blades, and these recesses can be are arranged to abut against the first side end in the fan blades.

The impeller device according to the invention can be substantially made of composite materials, and the impeller device's individual components can be isolated from one another by an insulating layer of glass fibre-reinforced plastic material.

Each fan blade can have an aerodynamic external shape with two or more internally metallic sleeves with internal threads integrated in the structure.

The end of the each blade can be S-shaped to reduce forces in the impeller's shaft.

The fan blades can be attached to the side disc(s) and the centre wheel by means of bolts being screwed in from the side of the side disc(s) opposite the centre wheel and in the centre wheel, said bolts being attached to through going sleeves. Discs can be used having a large abutment surface mounted both against a nut-milled composite seat and metal lining with cochleate end sides in the side discs, with the result that the bolt prestressing forces are uniformly distributed between the composite seat and the lining.

The invention comprises also a centrifugal fan made substantially of composite materials, comprising an impeller device as described above. The centrifugal fan can have a fan casing equipped with self-sealing and internally smooth inspection hatches on the fan casing, which can be opened by a toggle device with a batten slightly longer than the width of the hatch. The inspection hatch(es) can have a handle which protrudes outside the hatch opening.

BRIEF DESCRIPTION OF THE DRAWINGS

An embodiment of the device according to the invention will now be described with reference to the attached drawings.

DETAILED DESCRIPTION

Figure 1:
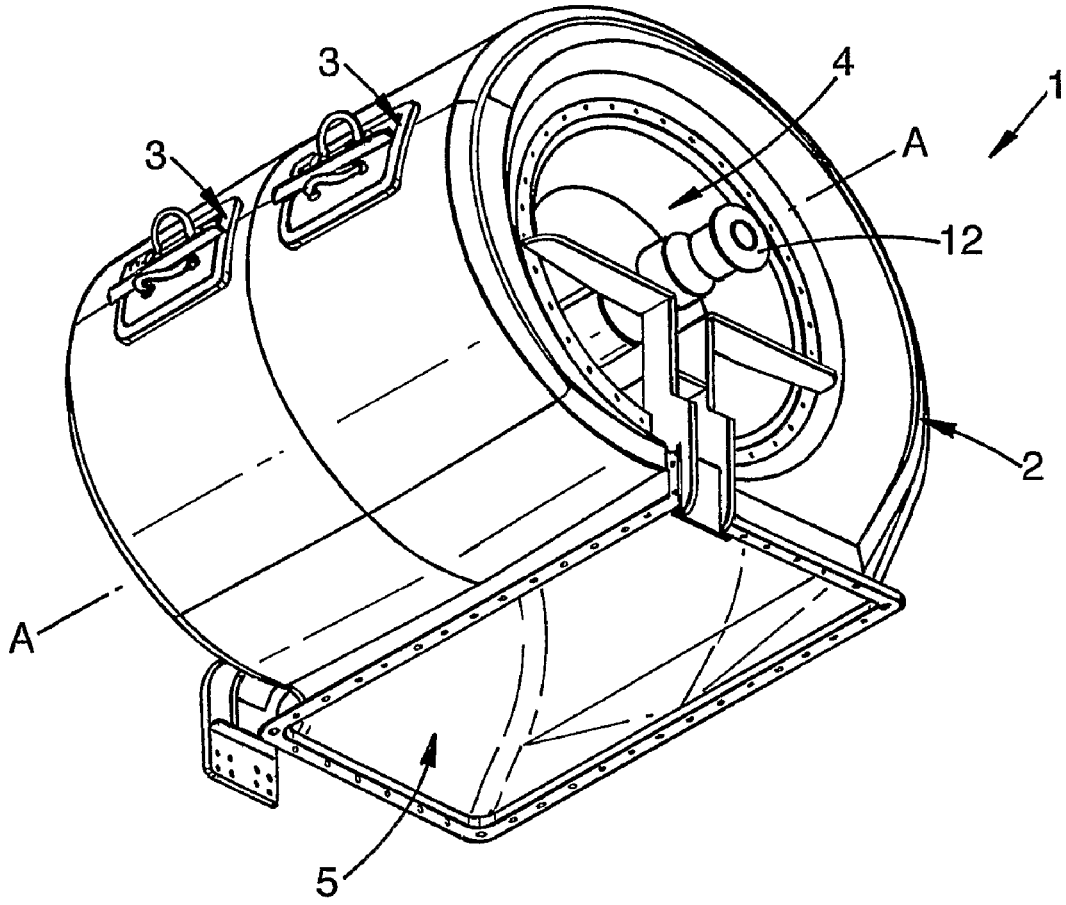
FIG. 1 is a perspective view of an embodiment of the centrifugal fan according to the invention.

An embodiment of the centrifugal fan according to the invention is illustrated in FIG. 1. The centrifugal fan 1 comprises a fan casing 2 with self-sealing and internally smooth fan hatches 3, an inlet 4 and an outlet 5.

The centrifugal fan 1 further comprises an impeller device (not shown in this figure) mounted on a shaft 12, where a drive device (not shown) rotates the impeller device via the shaft 12. The impeller device's axis of rotation is indicated by A-A. An embodiment of the impeller device according to the invention will now be described in detail.

Figure 2A:
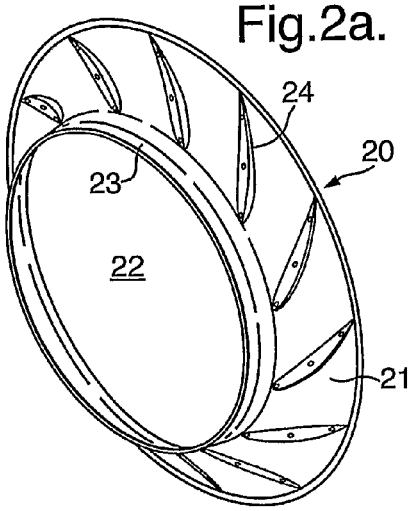
FIG. 2*a* illustrates a first side disc in an impeller device according to the invention.
Figure 2B:
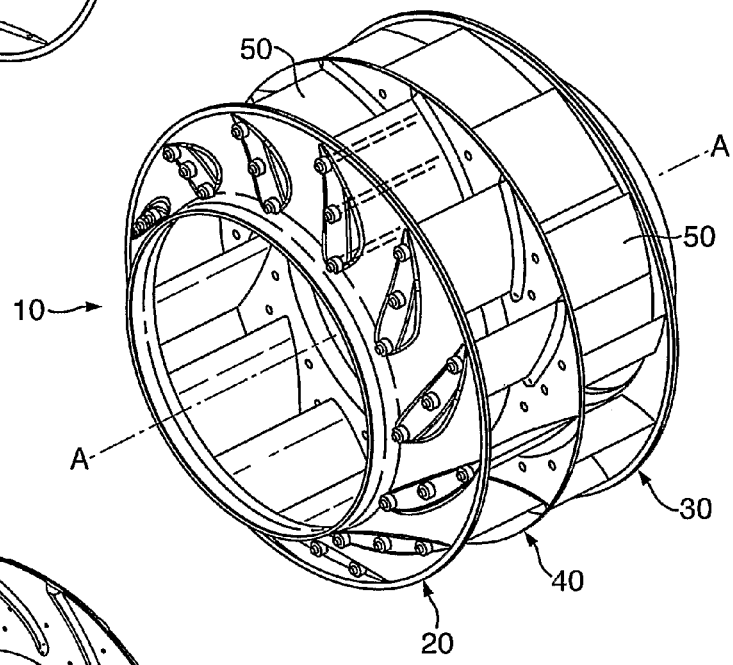
FIG. 2*b* is a perspective view of the impeller device including the side disc in FIG. 2*a*.

FIG. 2*b* illustrates an embodiment of the impeller device 10 according to the invention. It comprises a first side disc 20 and a second side disc 30 mounted on each side of a centre wheel 40. The first side disc 20 and the centre wheel 40, and the centre wheel 40 and the second side disc 30 respectively, are attached to one another via fan blades 50 by means of attachment devices 60, and via screws in the central part of the discs. The attachment devices 60 (see FIG. 7*a*) preferably comprise a metallic tubular tension rod with bolt threads at each end (the same applies for part 61 in FIG. 9*b*).

FIG. 2*a* illustrates the first side disc 20 which is substantially annular with a substantially curved radial area 21 and a central opening 22. Near the central opening 22 the side disc comprises a flange 23 in the radial direction, facing away from the centre wheel 40. The flange 23 forms a part of the inlet 4 in the centrifugal fan.

The first side disc 20 further comprises first attachment devices 24 for attachment of a first side end of the blades 50. The attachment devices 24 are situated on the side facing the centre wheel 40 and comprise a recess 101 (see FIG. 5*a*) adapted to receive a blade 50 and to abut against parts of the periphery of the blade, to provide support against centrifugal forces. There are also provided holes adapted to the attachment device 60 for attaching the blade 50 to the side disc, and this will be described in greater detail later.

It should be noted that in this embodiment the second side disc 30 is designed in the same way as the first side disc 20.

Figure 2C:
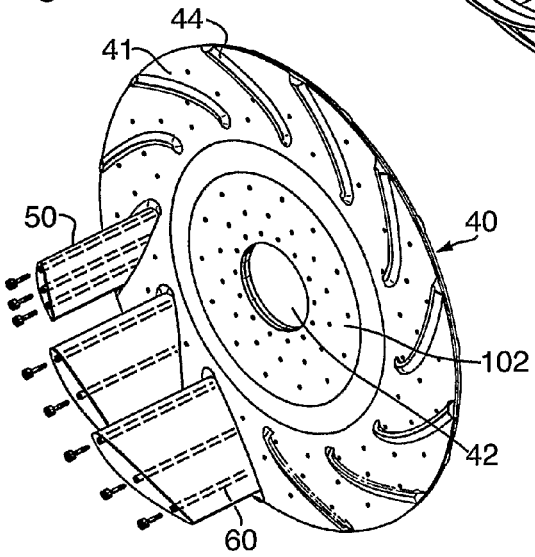
FIG. 2*c* illustrates a centre wheel in the impeller device in FIG. 2*b* with three fan blades.

FIG. 2*c* illustrates the centre wheel 40. The centre wheel is annular in form and substantially flat, comprising a peripheral area 41 and a central opening 42. The opening 42 is smaller than the opening 22 in the side disc 20, and in order to connect the impeller device 10 to the drive device, the shaft 12 is connected to the centre wheel 40. The area closest to the opening 42 therefore forms a flange 102 comprising a number of holes 103 which enable the centre wheel 40 to be attached to the shaft 12 (see also FIG. 6*a*).

Figure 3A:
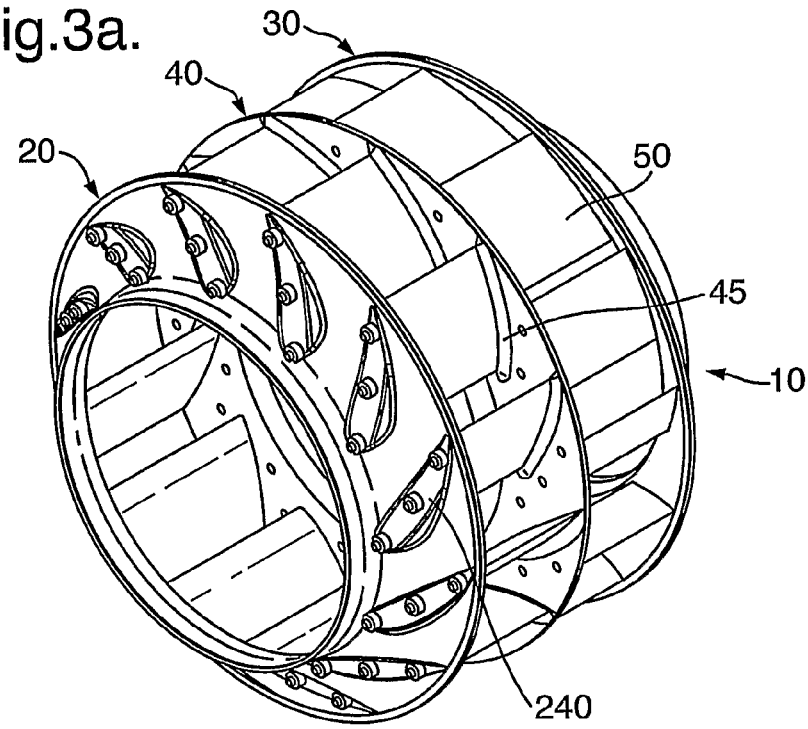
FIG. 3*a* illustrates an impeller device according to the invention.
Figures 6A, 6B, 6C:
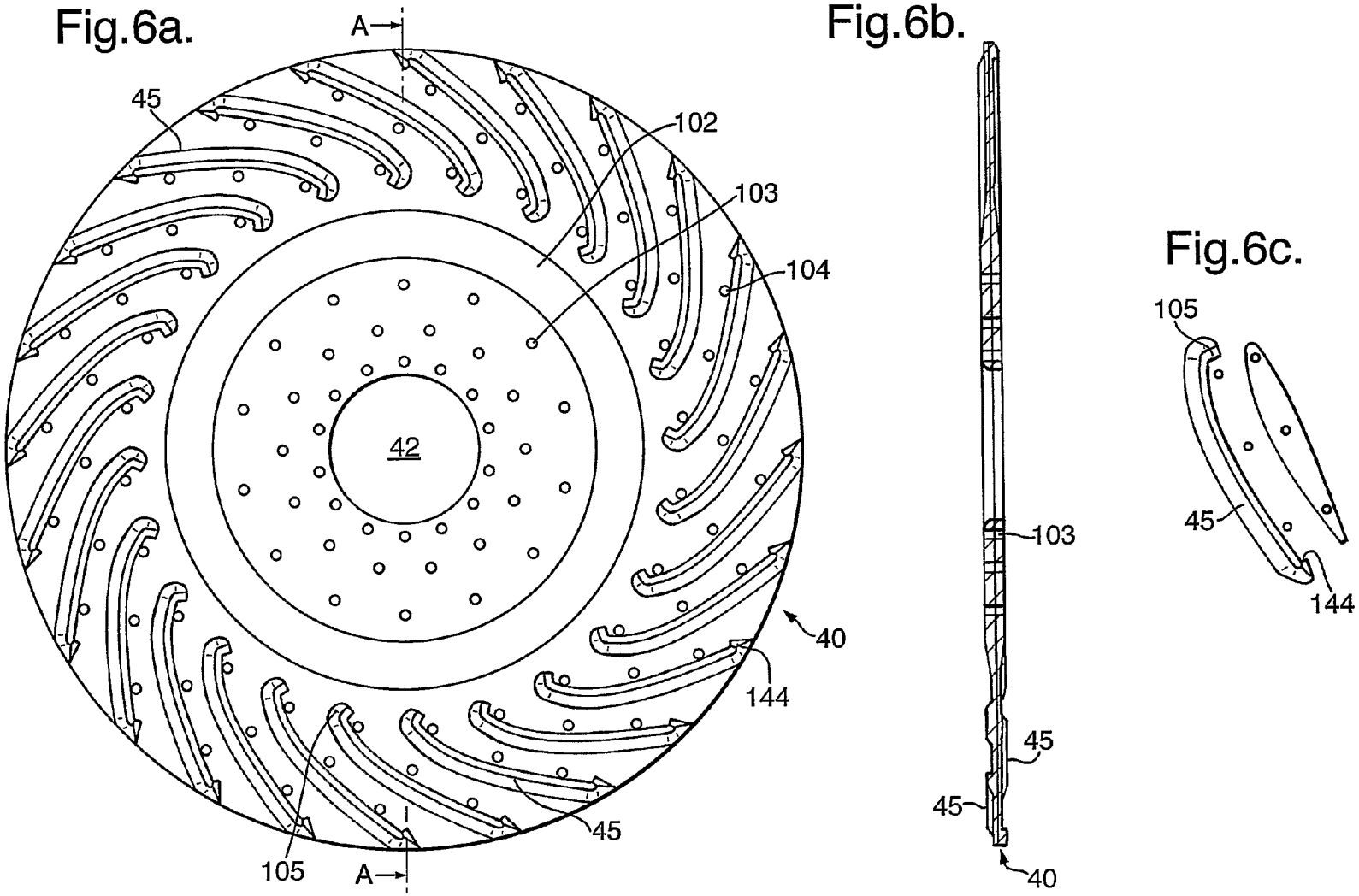
FIG. 6*a* illustrates the centre wheel according to the invention viewed from in front.
FIG. 6*b* is a side view of the centre wheel in FIG. 6*a*.
FIG. 6*c* illustrates the position of the blades in the centre wheel.
Figure 6D:
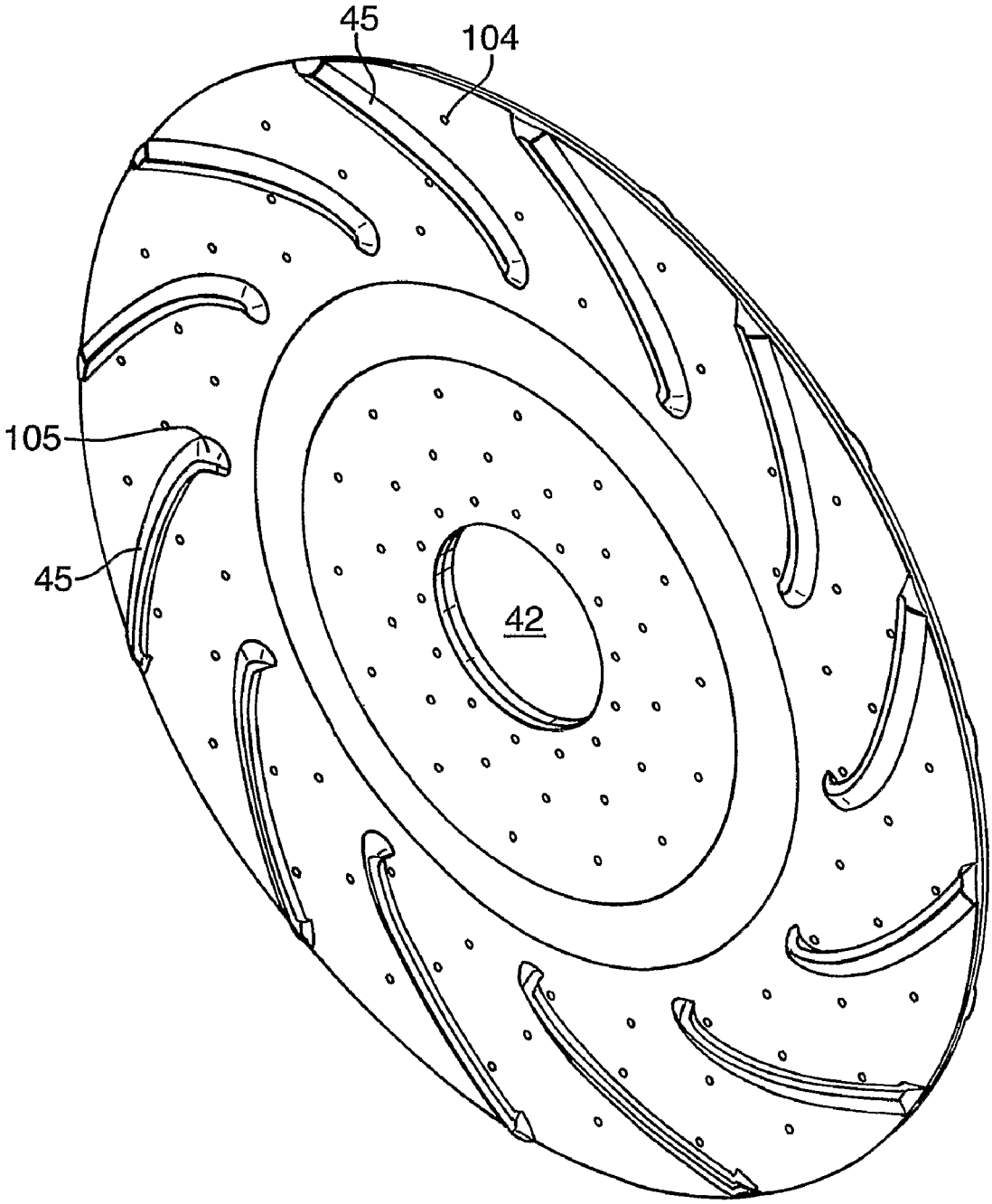
FIG. 6*d* is a perspective view of the centre wheel in FIG. 6*a*.

The centre wheel 40 further comprises second attachment devices 44 for attaching a second side end of the blades 50. The attachment devices 44 are mounted on both sides of the centre wheel 40, since blades 50 are mounted on both sides of the centre wheel 40 in this embodiment of the invention. In a second embodiment the impeller device 10 comprises only one set of blades 50, in which case the centre wheel only has attachment devices 44 on one side. The attachment devices 44 preferably comprise an oblong protrusion 45 protruding a distance from the centre wheel 40 (see FIG. 6*a*) and extending substantially in the centre wheel's radial direction. In FIGS. 3*a*, 6*c* and 7*c* it can be seen that the protrusion 45 is shaped to conform with parts of the periphery of the blade 50, thereby forming a support for the blade 50. As in the case of the attachment device 24 described above, here too holes are provided for the attachment device 60 for securing the blade 50 to the centre wheel 40, and this will be described in greater detail later.

FIG. 3*a* is a perspective view of the impeller device 10 according to the invention. It can be seen in the figure that each blade 50 is prevented from moving outwards in a radial direction due to the centrifugal forces. The said attachment of the blades against centrifugal forces consists, amongst other things, of the protrusions 45 in the centre wheel 40 as well as the recesses 101 in the side discs 20 and 30. The recesses 101 form a protrusion 240 on the outside of the side discs 20, 30. Thus the attachment ensures positioning and load transfer from the blade 50.

Figure 3B:
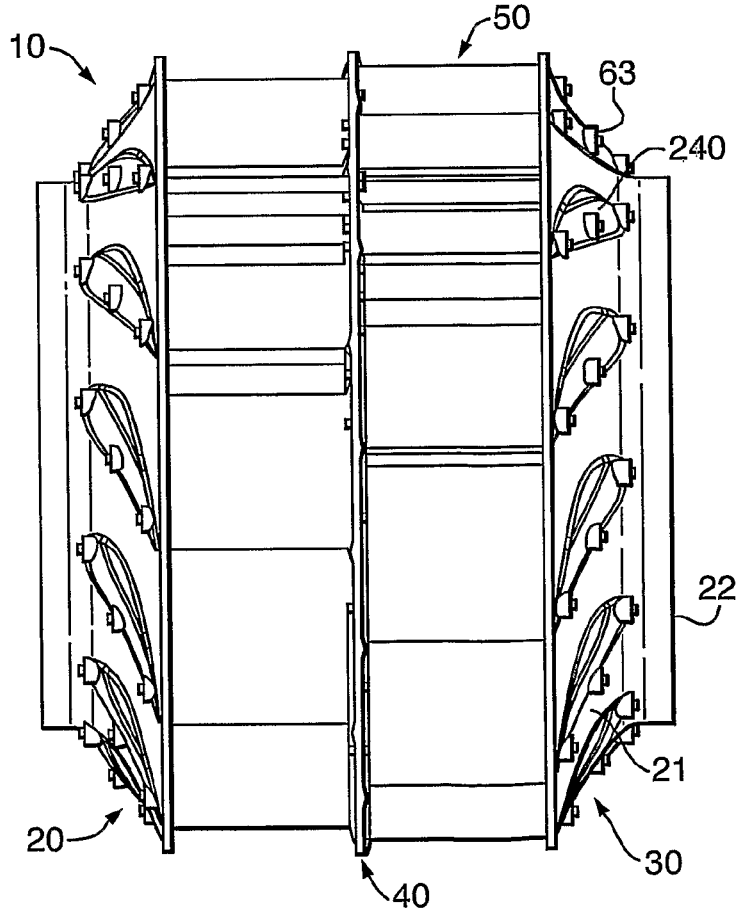
FIG. 3*b* is a side view of the impeller device in FIG. 3*a*.

FIG. 3*b* is a side view of the impeller device in FIG. 3*a*. The figure shows the head of the bolts 63 against a nut-milled seat on the side discs 20, 30 for prestressing of tension rods in the attachment device 60. In an embodiment of the invention the bolts 63 are made of steel. These bolts 63 and tension rods will also help to absorb the forces pushing the blades 50 outwards in the centrifugal direction. In a second embodiment of the invention the bolts are made of titanium. Metal rods are suited for threads and bolt connections.

Figure 4A:
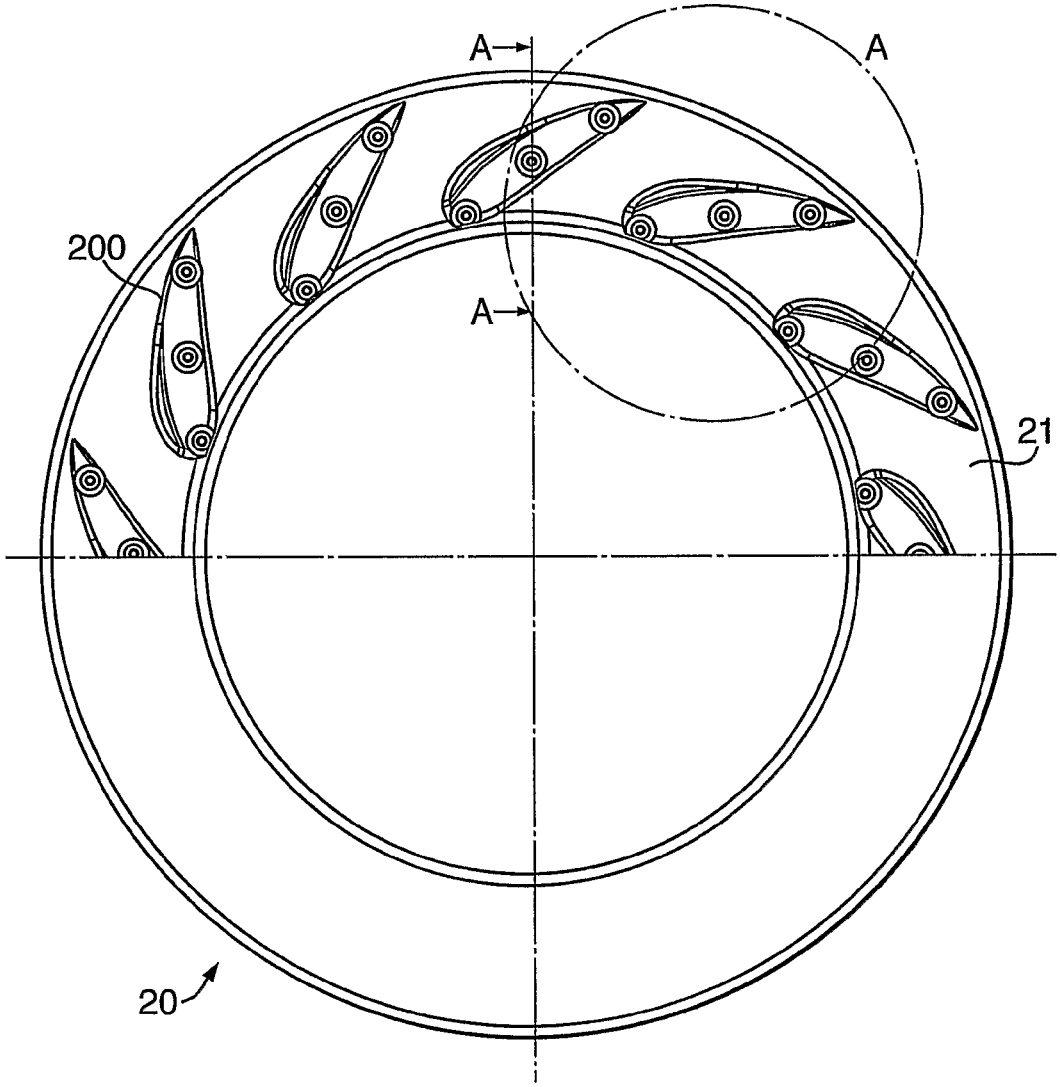
FIG. 4*a* illustrates a side wheel according to the invention viewed from in front.
Figure 4B:
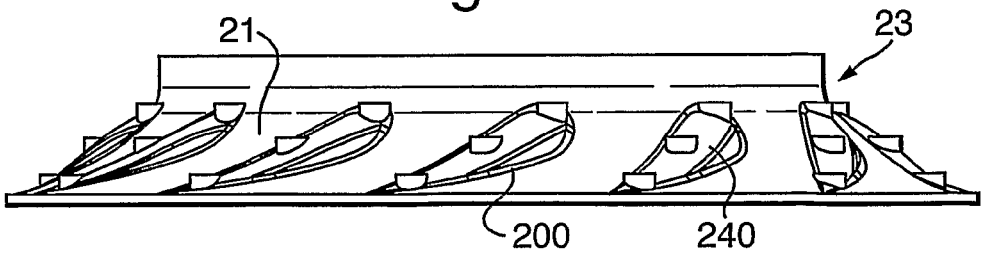
FIG. 4*b* is a side view of the side wheel in FIG. 4*a*.

FIGS. 4*a* and 4*b* illustrate a side wheel 20, 30 in front view and side view respectively. Reference numeral 200 indicates contour lines for the fibre cloth, i.e. corresponding to elevation contour lines on a map in the area of the protrusions 240. It is important to point out that although protrusions 240 have a shape which to a certain extent matches the shape of the blades' ends, attachment devices 24 in this embodiment of the invention do not surround the whole periphery of the blade's ends. This facilitates the removal of individual blades without disassembling the impeller device. It is also possible to provide an embodiment where attachment devices 24 surround the whole periphery of the blades' ends, in this case removal of a blade will include a rotation movement centered in said attachment device.

Figure 5A:
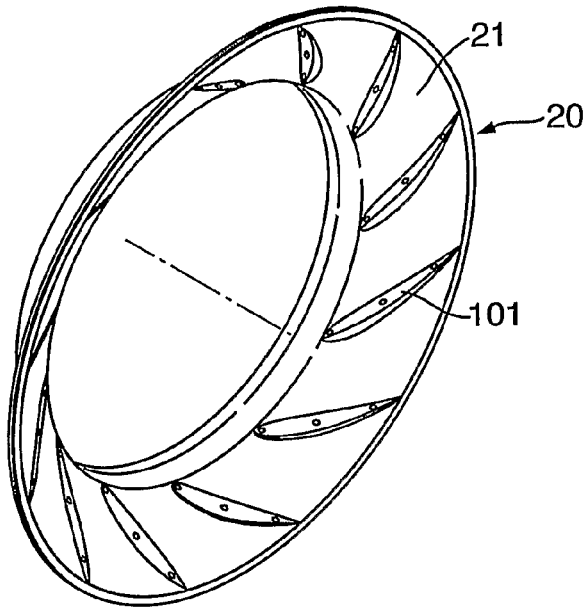
FIG. 5*a* is a perspective view from the rear of the side wheel in FIG. 4*a*.

FIG. 5*a* illustrates the side wheel in FIG. 4*a* viewed from the side facing the centre wheel 40. In this embodiment of the invention the recesses 101 are oblong with an oval shape (aerofoil profile). This embodiment of the invention (see FIG. 7*d*) is suitable for fans of the order of 1.5-2 m in impeller diameter and with a rotation speed of between 1000 and 2000 revolutions per minute.

Figure 8A:
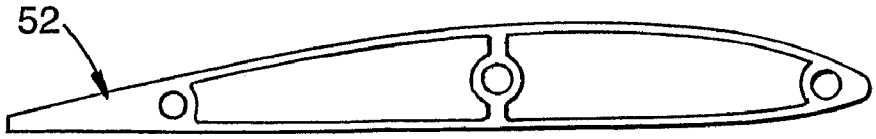
FIG. 8*a* illustrates a second embodiment of the fan blade according to the invention.
Figure 8B:
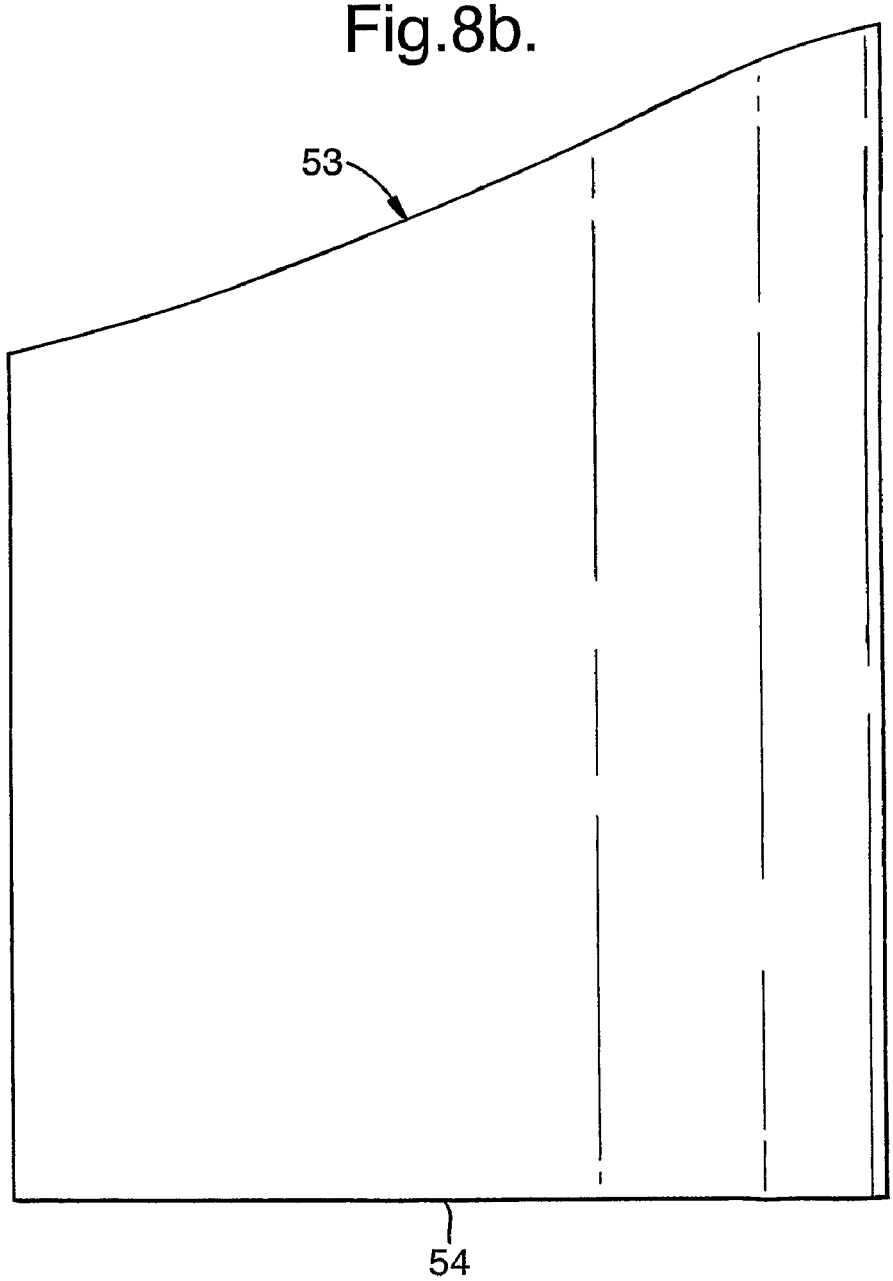
FIG. 8*b* illustrates the fan blade in FIG. 8*a* viewed from above.

For fans with a higher speed (of the order of 2000-4000 g, where g is the gravitational acceleration), the end of the blade is S-shaped (FIG. 8*b*). This kind of shape leads to lower forces on the shaft.

The sloping area 21 gives the fan a more aerodynamic shape in a high-speed fan of this kind where the fan inlet requires a curved shape on the inside of the side disc.

Figure 5B:
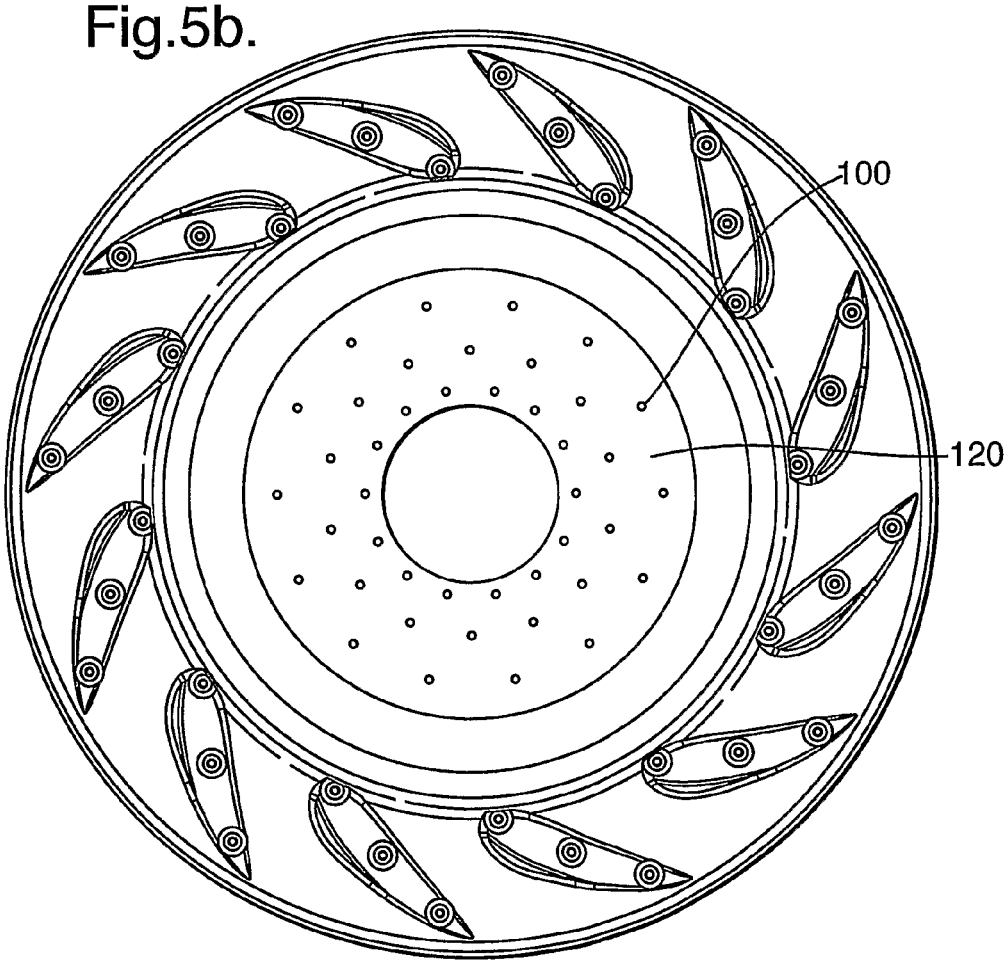
FIG. 5*b* illustrates the side wheel in FIG. 4*a* viewed from in front with the bolts in the centre wheel for attachment to the shaft.

FIG. 5*b* illustrates the side wheel in FIG. 4*a* viewed from in front with centre wheel 120 with bolt fastening 100 to the shaft.

FIGS. 6*a*, 6*b* and 6*c-d* illustrate the centre wheel 40 in one embodiment of the invention in front, side and perspective view respectively. FIG. 6*a* illustrates the opening 42 in the centre wheel 40 and the flange 102 with apertures 103 for attaching the centre wheel to the shaft 12 (not shown). The figure further illustrates apertures 104 for positioning the centre wheel during manufacture and for attachment of the blades 50 to the centre wheel 40. The centre wheel 40 is manufactured as two halves. Firstly one half is manufactured with attachment devices 44, whereupon this is placed in a jig with recesses that engage with the protrusions 45, and apertures 104 are made. A second half is manufactured in the same way and finally the halves are joined together. The figure also illustrates the attachment devices 44 with protrusion 45. The protrusions 45 comprise in this embodiment of the invention a curved end 105 where the object is to form an additional attachment for the blades 50. This end 105 also called "nose hook" and is shaped to offer the possibility of knocking out a blade 50 after the bolts 63 have been loosened (in the event of damage to individual blades). It is also possible to provide protrusions which do not comprise "nose hooks". The second end 144 of the protrusions 45, which is also called "tail hook", secures the blade in position in addition to the actual protrusion 45.

Figure 7A:
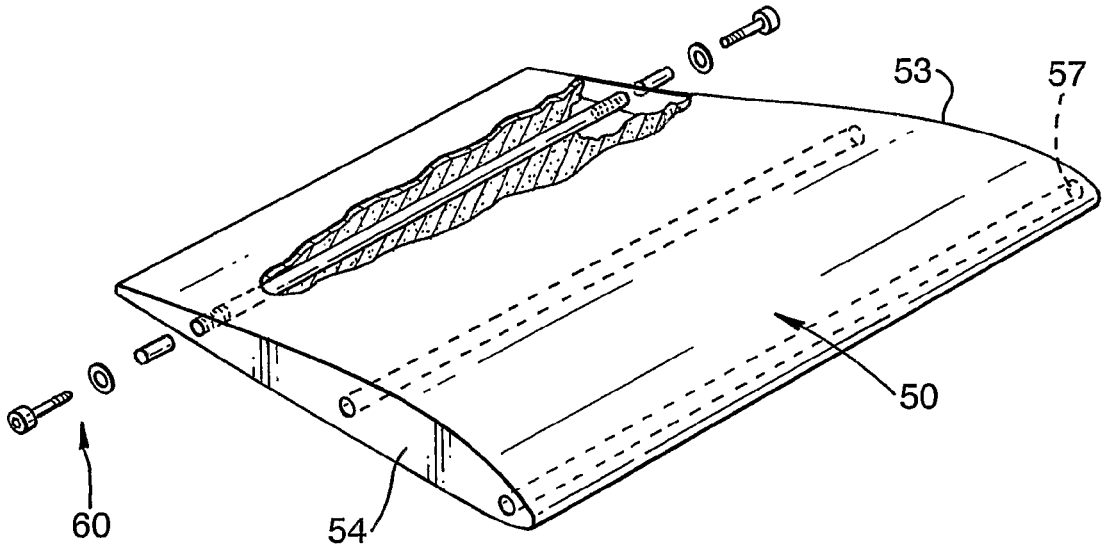
FIG. 7*a* is a perspective view of a fan blade according to the invention.
Figure 7B:
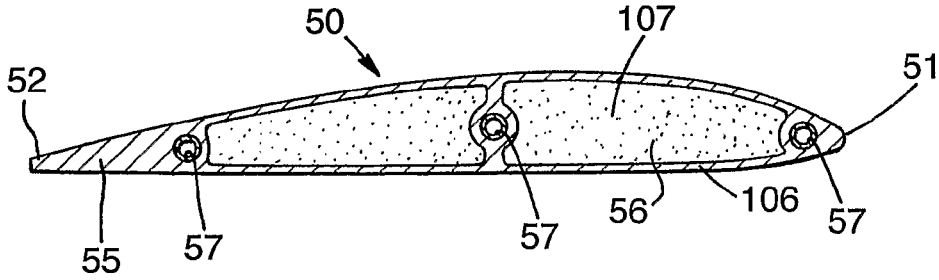
FIG. 7*b* is a side view of the fan blade in FIG. 7*a*.
Figure 7C:
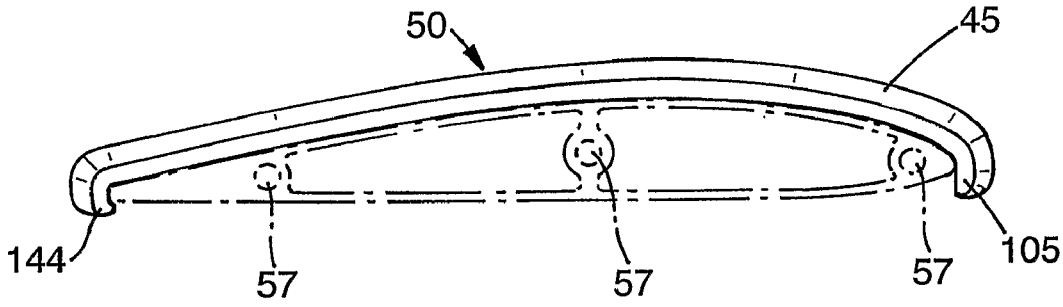
FIG. 7*c* illustrates the fan blade in FIG. 7*a* inserted in the centre wheel.

FIGS. 7*a*, 7*b* and 7*c* illustrate a fan blade according to the invention in perspective view, side view and inserted in the centre wheel 40 respectively. The blade 50 is designed with a flow-assisting wing profile with a leading edge 51 that is thicker than the trailing edge 52 (see FIG. 7*b*). The leading edge 51 will be arranged closer to the shaft 12. Furthermore, the blade 50 has a first side end 53 for mounting on to the attachment device 24 in the first side disc 20, and to a corresponding attachment device in the second side disc 30, and a second side end 54 for mounting on to the attachment device 44 in the centre wheel 40.

The trailing edge 52 of the blade 50 is approximately pointed with a 90 degree edge to allow the air to flow more easily. The point is cut since this makes the tail stronger and stiffer.

As illustrated in FIG. 7*b* the first side end 53 and the second side end 54 comprise a support structure 55 which is preferably made of composite. Between these support structures a blade body 56 of a composite material is integrated. The blade body 56 is in the form of the above-mentioned wing profile and contains through-going openings 57 in the metal rod (saving weight).

Figure 7D:
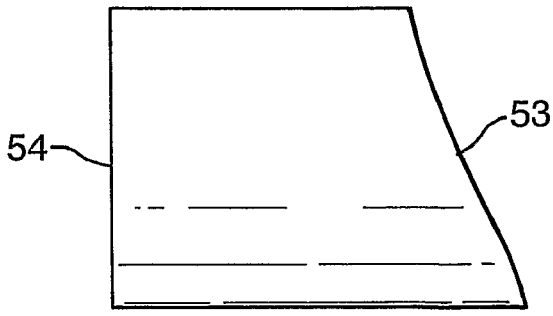
FIG. 7*d* illustrates the fan blade in FIG. 7*a* viewed from above.

FIG. 7*d* illustrates the fan blade in FIG. 7*a* viewed from above, and shows the shape of the side ends 53 and 54. The first side end 53 is preferably designed so that it fits into the attachment device 24 in a side disc 20, 30. Since the attachment device 24 is partly mounted in the curved area 21 in the side disc 20, the first side end 53 will also have a curvature adapted to the area 21. This curvature makes it possible to make an aerodynamic impeller with solid support at the lateral surfaces.

The second side end 54 is also designed so that it fits into the attachment device 44, and consequently has a substantially flat surface.

FIGS. 8*a* and 8*b* illustrate a second embodiment of the fan blade 50 according to the invention. This embodiment is suitable for high rotation rates. In this embodiment the rear edge 52 has a straight termination. The object of this is to protect the exposed tail tips against impact from objects that may pass through the impeller. This embodiment leads to substantially less noise than other embodiments when the fan has to rotate at approximately 1900 rpm with air velocities up around 120 m/sec. It can be seen from the figure that the first side end 53 in this blade 50 is S-shaped in order to obtain an aerodynamic inlet to the fan.

Figure 9A:
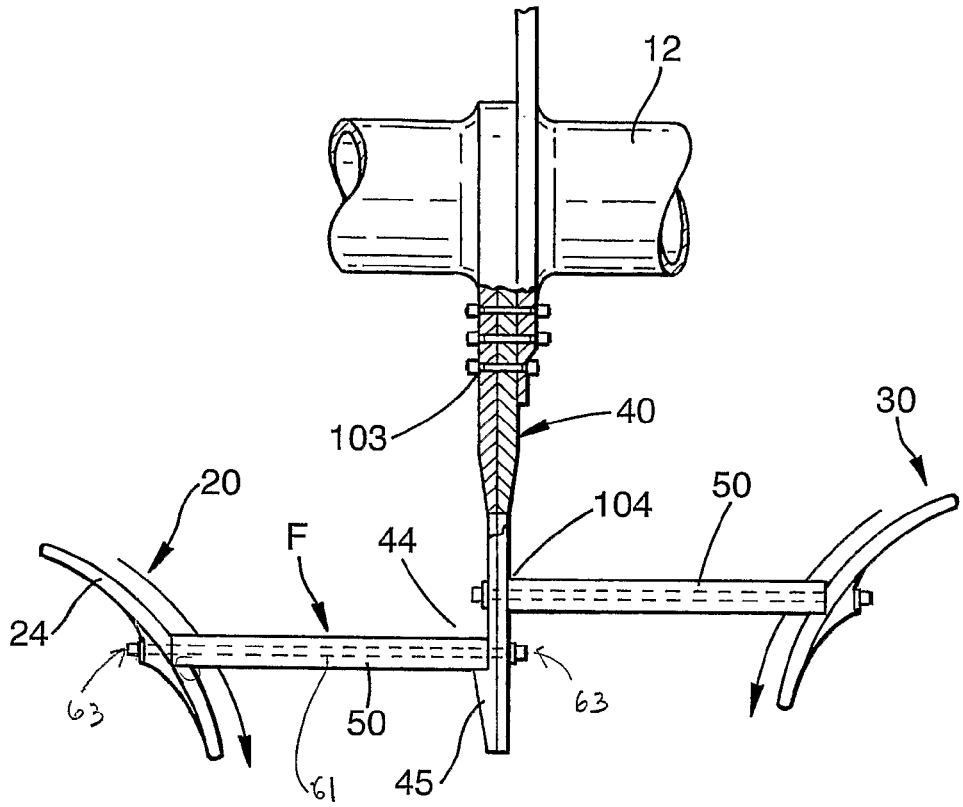
FIG. 9*a* illustrates the attachment between the centre wheel, the first and second side discs and the fan blades.
Figure 9B:
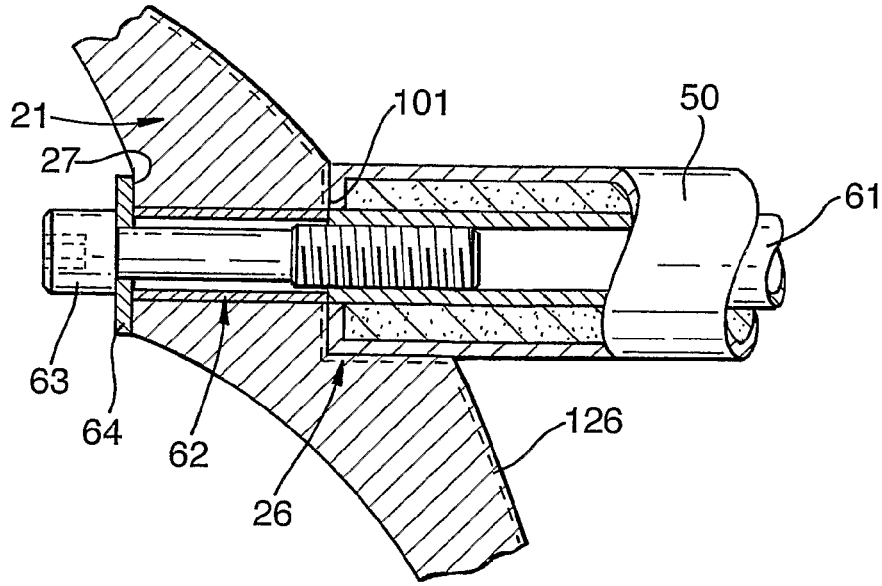
FIGS. 9*b* and 9*d* illustrate a detail from FIG. 6*a*.

FIG. 9*a* illustrates the attachment between the centre wheel 40, the first and second side discs 20 and 30 respectively and the fan blades 50, and FIG. 9*b* also illustrates a detail from FIG. 9*a*. The connection is carried out in such a manner that the blades 50 are placed in the attachment devices 44 in the centre wheel 40 and in the attachment devices 24 in the side discs 20, 30 and secured by means of a fastening device 60. As one can see from the figure, when the blades 50 are in place on the attachment devices 44 and 24, only the lower part of the blades is prevented from moving in the radial direction by means of said attachment devices. This makes possible to remove one defective blade by loosening bolts 63 and exerting a force towards the shaft 12.

The fastening device 60 comprises hollow, e.g. metallic sleeves 61 or metal tubular rods placed in through-going opening 57 in the blade body 56 (FIG. 7*c*) and two bolts 63 for each sleeve, where the bolts are arranged at each end of the sleeves. The sleeve 61 comprises an internally threaded portion at each end. Furthermore, a hollow, preferably metallic sleeve 62 is mounted in the openings in the attachment devices 24, 44 in the first side disc 20 and the centre wheel 40 respectively. The object of the sleeve 62 is to ensure that the bolt cannot dig its way into the composite. The fastening device 60 further comprises a bolt 63 which is inserted into a disc 64, the sleeve 62 in the side disc 20, the blade's support structure 55 and then screwed to one end of the sleeve 61 in the blade 50. In the same way the blade 50 is attached to the centre wheel 40, and in the same way the blades 50 are attached between the centre wheel 40 an the second side disc 30.

Figure 9C:
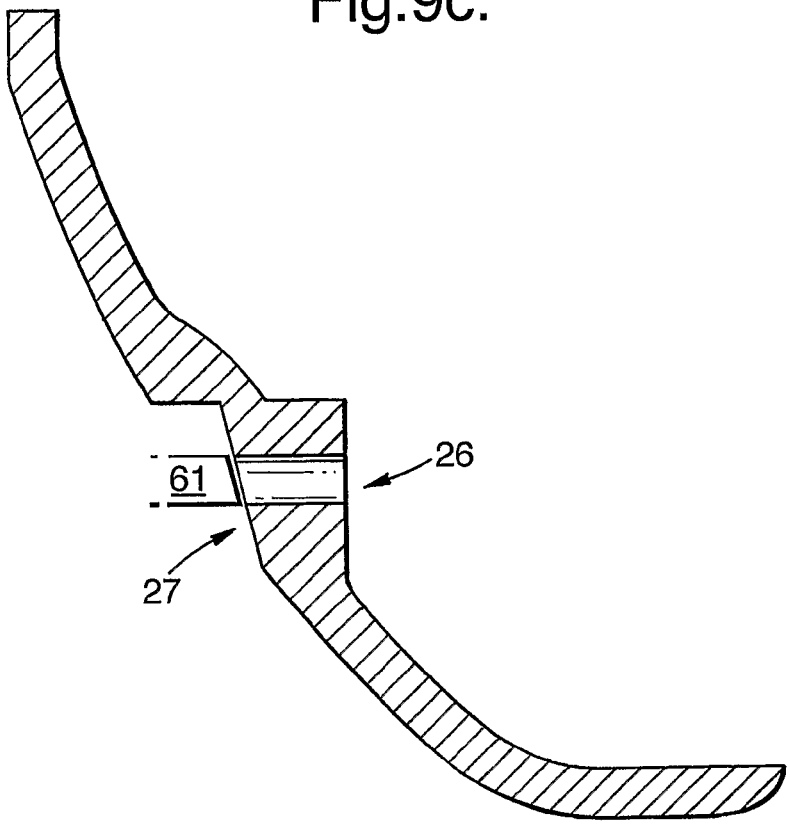
FIG. 9*c* illustrates a part of the side wheel in FIG. 4*a*.
Figure 9D:
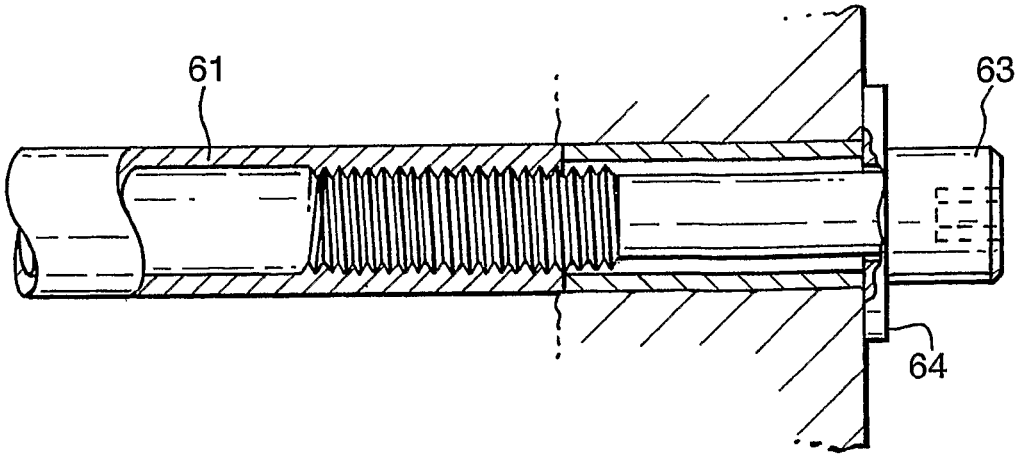

It should be noted that the attachment device 24 in the first side disc 20 comprises a portion 26 adapted to receive the blade 50 (FIGS. 9*b*, 9*c*). On the opposite side of the first side disc 20, the side disc 20 comprises a portion 27 substantially parallel to the centre wheel 40. This arranges for the forces from the attachment of the blades to be absorbed perpendicularly to the direction of rotation of the impeller device 10.

Reference numeral 126 refers to an electrically insulating layer e.g. of glass fibre covering the whole of the blade side. The layer may also cover the blades 50 if a wear layer is required. The inside of the side discs 20, 30 and of the centre wheel 40 is insulated in order to reduce the eddy current effect.

Figure 10:
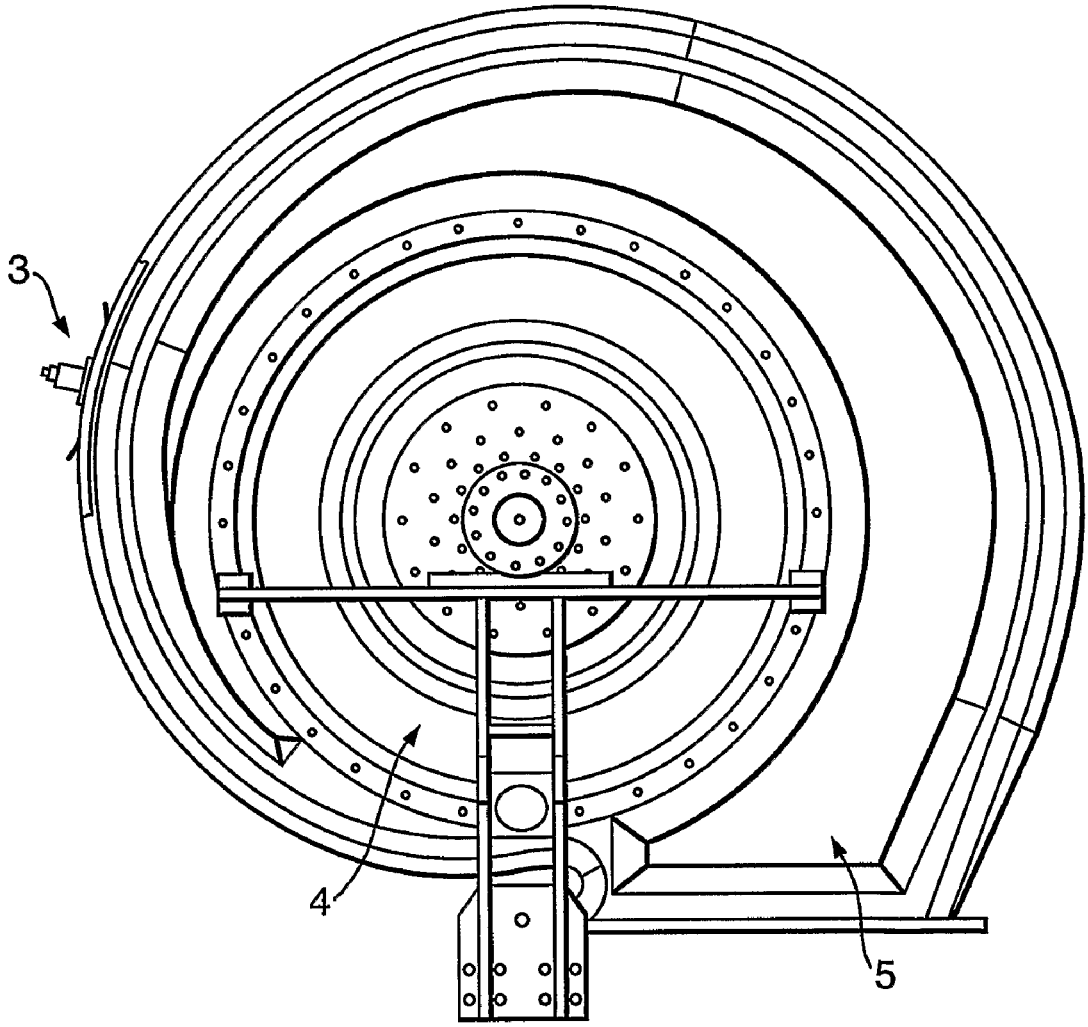
FIG. 10 illustrates the centrifugal fan according to the invention with an inspection hatch in the fan casing.
Figure 11A:
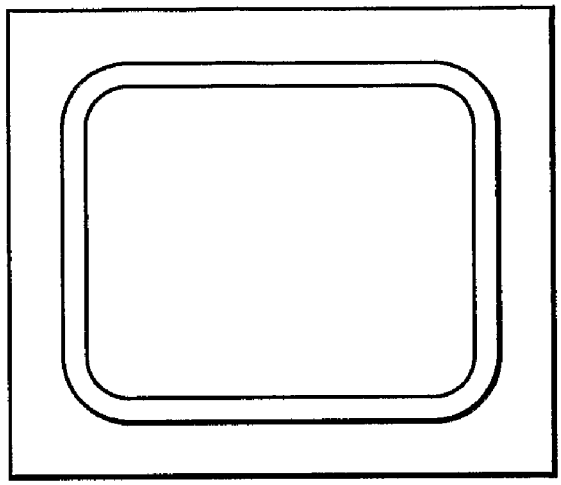
FIGS. 11*a-d* illustrate details of the inspection hatch.
Figure 11B:
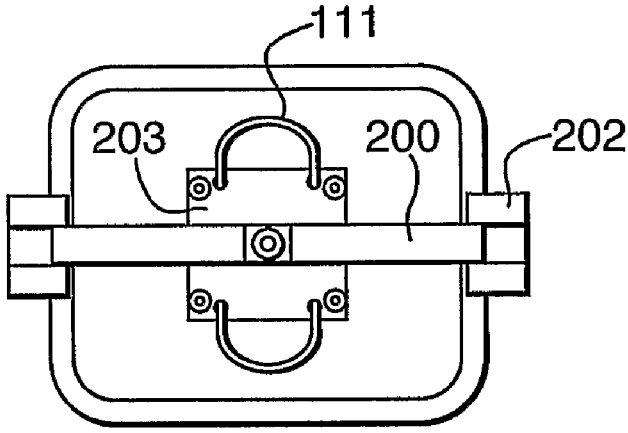
Figure 11C:
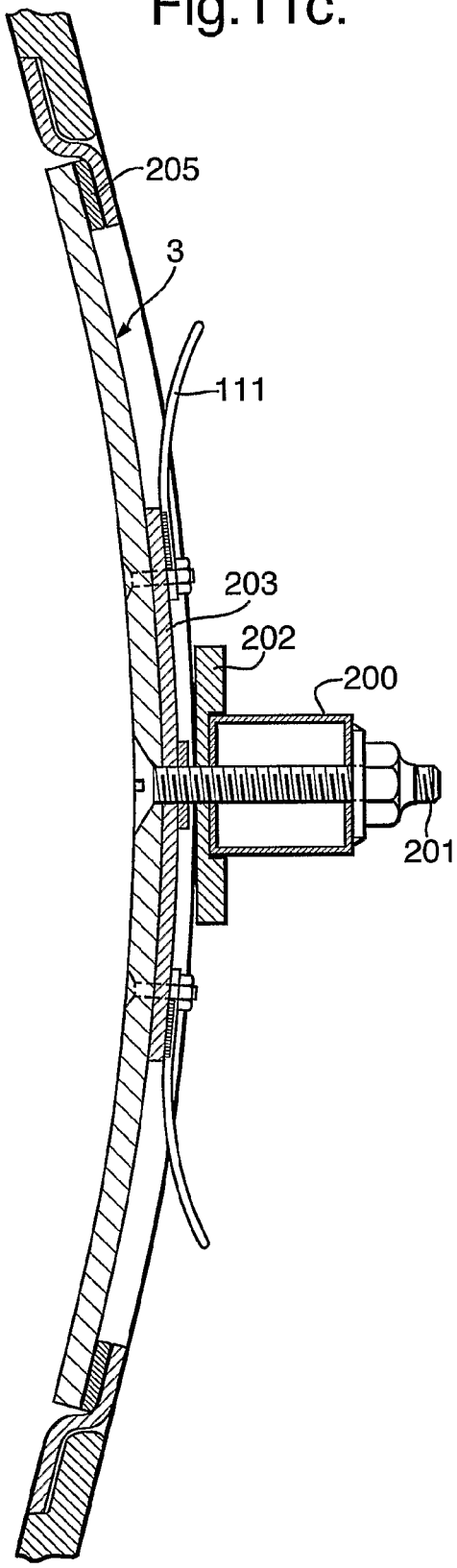
Figure 11D:
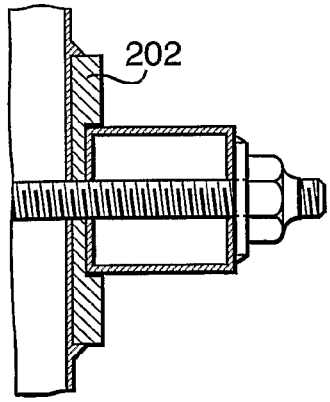

FIG. 10 illustrates the centrifugal fan according to the invention with an inspection hatch in the fan casing.

The curved areas 21 in the side discs 20, 30 form a part of the inlet 4 in the centrifugal fan 1. The airflow then passes between the side discs and the centre wheel past the blades 50 and on out to the outlet 5 through the discharge. The casing 2 can have a cochleate discharge as illustrated in FIG. 10. Since the attachment device 24 in this embodiment surrounds the whole lateral edge of the blade 50, the attachment devices 24 provides a stable attachment of the blades 50 and ensure that the centrifugal forces are uniformly distributed to the first side disc 20.

FIGS. 11 *a-d* illustrate details of the inspection hatch 3. The hatch 3 is connected to a toggle batten 200, which in addition to a gasket 205 on the inside of the fan casing seals the hatch. To open the hatch, the screw mechanism is loosened, the shoe 202 (which ensures that the toggle is securely located) is rotated and the toggle 200 is rotated diagonally. The hatch 3 can then be tilted into the casing and rotated before the narrowest path on the hatch rectangle is pulled out of the widest aperture 111 indicates a handle that is attached to the hatch 3 by means of the plate 203. This arrangement provides a smooth surface on the inside of the fan casing, it is self-sealing and moreover prevents the hatch from falling into the fan casing by mistake

The invention claimed is:

1. An impeller device for centrifugal fans, comprising:

a centre wheel;

at least one side disc;

fan blades, where the fan blades have a radially inner leading edge, a radially outer trailing edge, a first side end and a second side end;

where the at least one side disc comprises first support-providing attachment devices having recesses adapted to receive the first side end of the blade and abut against parts of the trailing edge of first side end of the blade to provide support against centrifugal forces;

where the centre wheel comprises second support-providing attachment devices having protrusions protruding an axial distance from the centre wheel and extending in the radial direction of the centre wheel, where the protrusions are shaped to conform with parts of a peripheral edge of the second end of the blade to provide support for the blade;

where the first support-providing attachment devices and the second support-providing attachment devices prevent the blades from moving in a radial direction; and bolt attachment devices for detachably securing the fan blades to the centre wheel and to the at least one side disc;

where the at least one side disc comprise a curved area, where the recesses are provided in the curved area of the at least one side disc.

2. The impeller device according to claim 1, where each protrusion comprises a curved end located closest to the centre of the centre wheel, the curved end being adapted to receive a part of the fan blade's second side end.

3. The impeller device according to claim 1, where it is substantially made of composite materials.

4. The impeller device according to claim 1, where the centre wheel and the at least one side disc are isolated from the blades by an insulating layer of glass fibre-reinforced plastic material.

5. The impeller device according to claim 1, where each fan blade has an aerodynamic external shape with two or more internally metallic sleeves with internal threads integrated in the blade.

6. The impeller device according to claim 1, where the end of the blades is S-shaped (FIG. 8*b*) to reduce forces in the impeller's shaft.

7. The impeller device according to claim 1, where the fan blades are attached to the side disc and the centre wheel by bolts connected to through going sleeves.

8. The impeller device according to claim 1, where the first support-providing attachment devices and second support-providing attachment devices prevent the blades from moving in a radial direction and/or a rotational direction.

9. A centrifugal fan made substantially of composite materials, comprising an impeller device comprising:

a centre wheel;

at least one side disc;

fan blades, where the fan blades have a radially inner leading edge, a radially outer trailing edge, a first side end and a second side end;

where the at least one side disc comprises first support-providing attachment devices having recesses adapted to receive the first side end of the blade and abut against parts of the trailing edge of first side end of the blade to provide support against centrifugal forces;

where the centre wheel comprises second support-providing attachment devices having protrusions protruding an axial distance from the centre wheel and extending in the radial direction of the centre wheel, where the protrusions are shaped to conform with parts of a peripheral edge of the second end of the blade to provide support for the blade;

where the first support-providing attachment devices and the second support-providing attachment devices prevent the blades from moving in a radial direction; and bolt attachment devices for detachably securing the fan blades to the centre wheel and to the at least one side disc;

where the at least one side disc comprises a curved area, where the recesses are provided in the curved area of the at least one side disc.

10. The centrifugal fan according to claim 9, where it comprises a fan casing equipped with self-sealing and internally smooth inspection hatches on the fan casing, which can be opened by a toggle device with a batten slightly longer than the width of the hatch.

11. The centrifugal fan according to claim 10, where the inspection hatches have a handle which protrudes outside the hatch opening.

* * * * *